US009636280B1

(12) United States Patent
Althallab

(10) Patent No.: US 9,636,280 B1
(45) Date of Patent: May 2, 2017

(54) PROGRAMMABLE NURSING BOTTLE

(71) Applicant: Fatemah Salem Althallab, Andalus (KW)

(72) Inventor: Fatemah Salem Althallab, Andalus (KW)

( * ) Notice: Subject to any disclaimer, the term of this patent is extended or adjusted under 35 U.S.C. 154(b) by 126 days.

(21) Appl. No.: 14/968,790

(22) Filed: Dec. 14, 2015

(51) Int. Cl.
*A61J 7/00* (2006.01)
*A61J 9/00* (2006.01)
*B65D 23/04* (2006.01)

(52) U.S. Cl.
CPC ..... *A61J 9/006* (2013.01); *B65D 23/04* (2013.01)

(58) Field of Classification Search
CPC ..... A61J 9/00; A61J 9/006; A61J 11/00; A61J 15/0011; A61J 15/0076
See application file for complete search history.

(56) References Cited

U.S. PATENT DOCUMENTS

| | | | | |
|---|---|---|---|---|
| 4,397,639 | A | 8/1983 | Eschweiler et al. | 604/153 |
| 6,033,367 | A * | 3/2000 | Goldfield | A61B 5/087 215/11.1 |
| 8,568,351 | B2 | 10/2013 | Al-Thalab | 604/77 |
| 8,568,352 | B2 | 10/2013 | Al Thalab | 604/77 |
| 8,852,144 | B2 | 10/2014 | Al-Thallab | 604/77 |
| 2008/0039778 | A1* | 2/2008 | Goldie et al. | A61B 5/038 604/67 |
| 2013/0161280 | A1* | 6/2013 | Thalab | A61J 9/00 215/11.1 |
| 2014/0242213 | A1* | 8/2014 | McCarty et al. | A61J 9/00 426/2 |
| 2015/0208979 | A1* | 7/2015 | Cunningham et al. | A61B 5/4552 600/590 |
| 2015/0335533 | A1* | 11/2015 | Pineda et al. | A61J 9/00 215/11.1 |

FOREIGN PATENT DOCUMENTS

| | | |
|---|---|---|
| JP | 2005042691 | 2/2005 |

OTHER PUBLICATIONS

"Simple 6 Button Universal Remote Control" Assistive Technology Services website www.assitivetechnologyservices.com, 2015.

* cited by examiner

*Primary Examiner* — Rebecca E Eisenberg
(74) *Attorney, Agent, or Firm* — Richard C. Litman

(57) ABSTRACT

The programmable nursing bottle includes a first housing member configured to hold a liquid therein, a second housing member removably attached to the first housing member and a tube member extending from the first housing portion through the second housing portion. The second housing member includes a pump assembly, a programmable control assembly including an interface, a controller operatively connected to the pump assembly, and a sliding door member provided about the second housing member. The door is configured to slide from a first position in which the interface is exposed to a second position in which the interface is covered.

15 Claims, 17 Drawing Sheets

PROGRAMMABLE NURSING BOTTLE

BACKGROUND OF THE INVENTION

1. Field of the Invention

The present invention relates to nursing bottles, and particularly, to a programmable nursing bottle particularly suited for pre-natal infants, infants with a cleft lip, and/or infants with a cleft palate.

2. Description of the Related Art

Cleft lips and cleft palates are common birth defects and require special attention during the initial six months of a child's life. To be more specific, there are three types of cleft lip, i.e., unilateral incomplete, unilateral complete and bilateral complete. There are also three types of cleft palates, namely the soft palate only, the unilateral complete, and the bilateral complete. However, each of the cleft lip and/or cleft palate malformations involves leakage of air from the mouth through the nose, which causes an infant to be unable to suck, causing regurgitation of fluids through the nose and difficulty in swallowing and breathing.

For a period of about six months until the infant has matured enough for corrective surgery, the infant must be fed. Feeding is not only the most immediate problem encountered in the daily care of an infant with a cleft lip and/or cleft palate, but it is one of the more difficult to solve and the most necessary for the survival of the child. For example, with respect to pre-natal infants, i.e., those born before 32 weeks, the suction reflex may not be fully developed, and the child may choke on nutrient from an ordinary bottle. Such choking may lead to infection.

Similarly, elderly individuals restricted to liquid diets often lack the strength or skills to feed themselves using conventional bottles and/cups. Accordingly, choking during feeding is also a concern for such individuals.

Thus, a programmable nursing bottle solving the aforementioned problems encountered by infants and elderly individuals, is desired.

SUMMARY OF THE INVENTION

The programmable nursing bottle includes a first housing member configured to hold a liquid therein and a second housing member removably attached to the first housing member. The programmable nursing bottle further includes a tube member extending from the first housing portion through the second housing portion. A pump assembly including a pump and a motor are disposed in the second housing member. The pump assembly is configured to pump fluid from the first housing member through the tube member. The second housing further includes a programmable control assembly including an interface and a controller operatively connected to the pump assembly, and a sliding door member provided about the second housing member. The sliding door is configured to slide between an open position in which the user interface is exposed and a closed position in which the user interface is covered. When the programmable nursing bottle is in an open position, the user is able to access the user interface to control the controller. In a closed position, the sliding door member activates the controller to initiate fluid flow by the pump.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
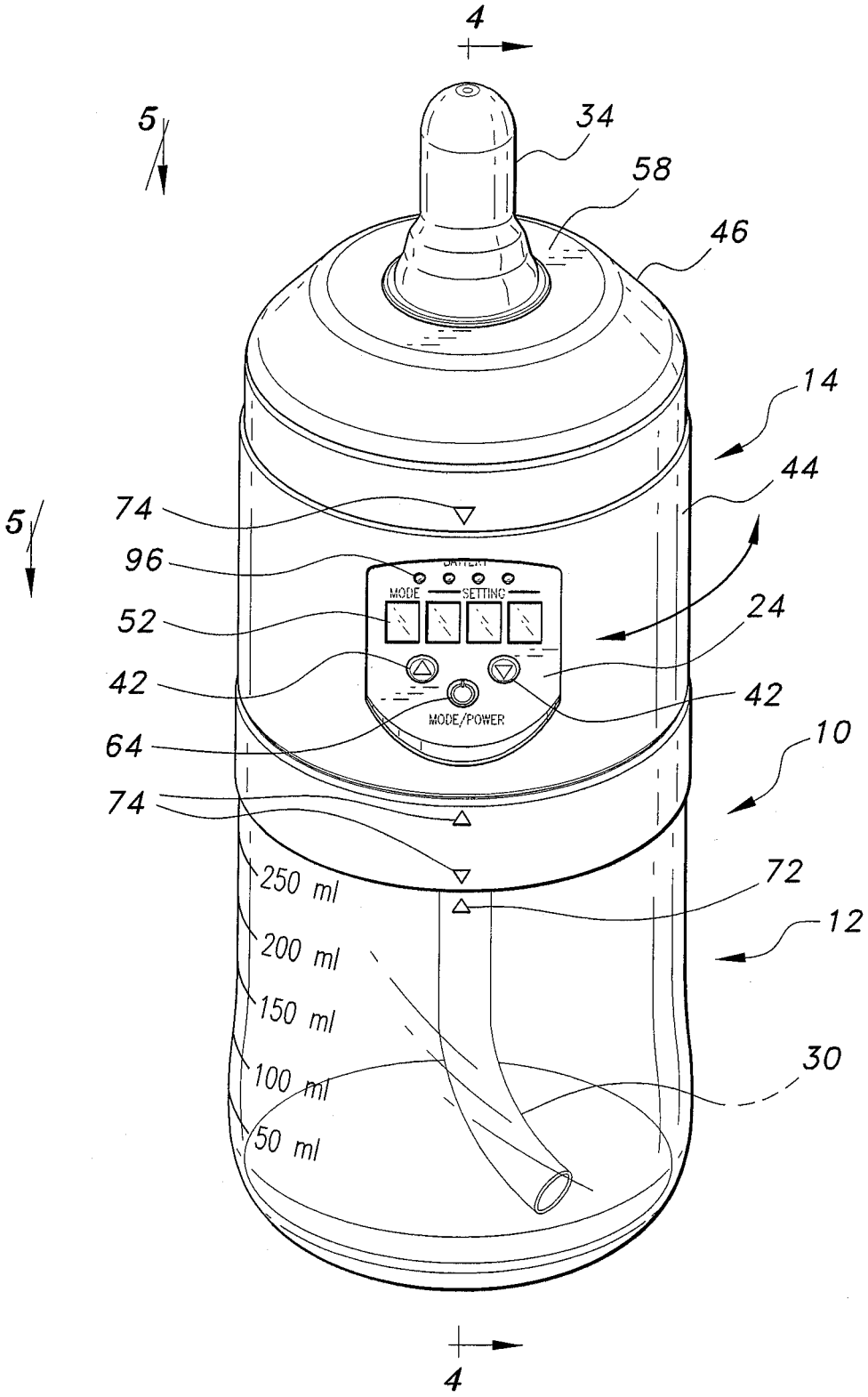
FIG. 1A is an environmental perspective view of a programmable nursing bottle according to the present invention, including an upper housing member and a lower housing member provided in a connected arrangement with each other, and a sliding door member provided in an open position.

Referring to FIGS. 1A-8, there is shown a programmable nursing bottle generally referred to by the reference number 10. The programmable nursing bottle 10 includes a first or lower housing member 12, a second or upper housing member 14, an elongated tube member 30, which extends generally from a lower portion 32 of the lower housing member 12 to an opening in a nipple 34 of the upper housing member 14, a programmable control assembly 24, a pump assembly 26 operatively connected to the control assembly 24 for controlling nutrient flow through the nursing bottle 10, and a sliding door member 44 operatively connected to the programmable control assembly for actuating operation of the nursing bottle 10 between an on and off position. The lower housing member 12 and upper housing member 14 may be removably connected to each other via a threaded connection, snap-fit connection or similar type of sealing feature. Visual indicators 72 and 74, provided respectively on the lower housing member 12 and upper housing member 14, assist the user in aligning the housing members 12, 14 during assembly.

Figure 1B:
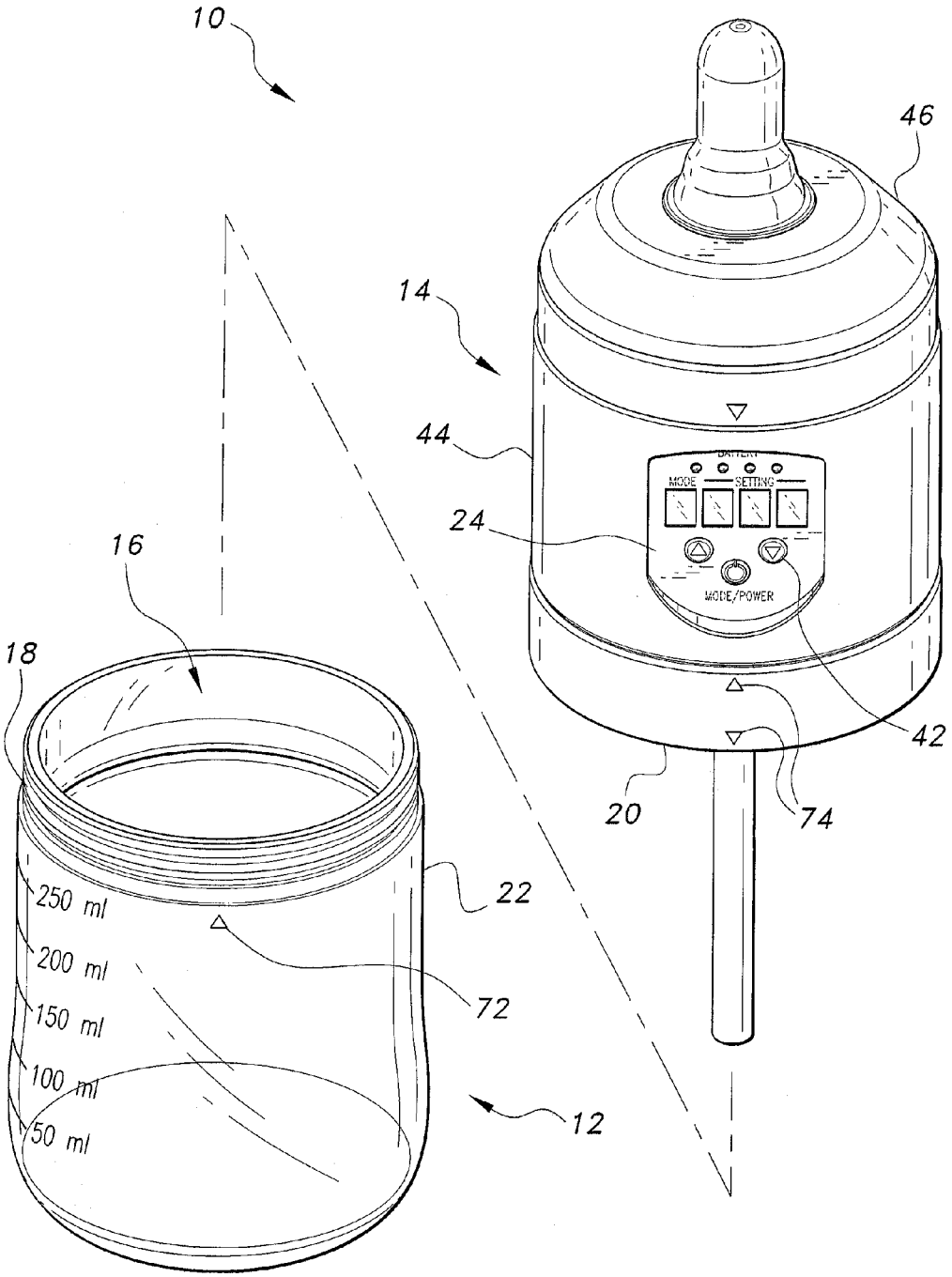
FIG. 1B is an environmental perspective view of the programmable nursing bottle of FIG. 1A, illustrating the upper housing member and the lower housing member in a disconnected arrangement.
Figure 4:
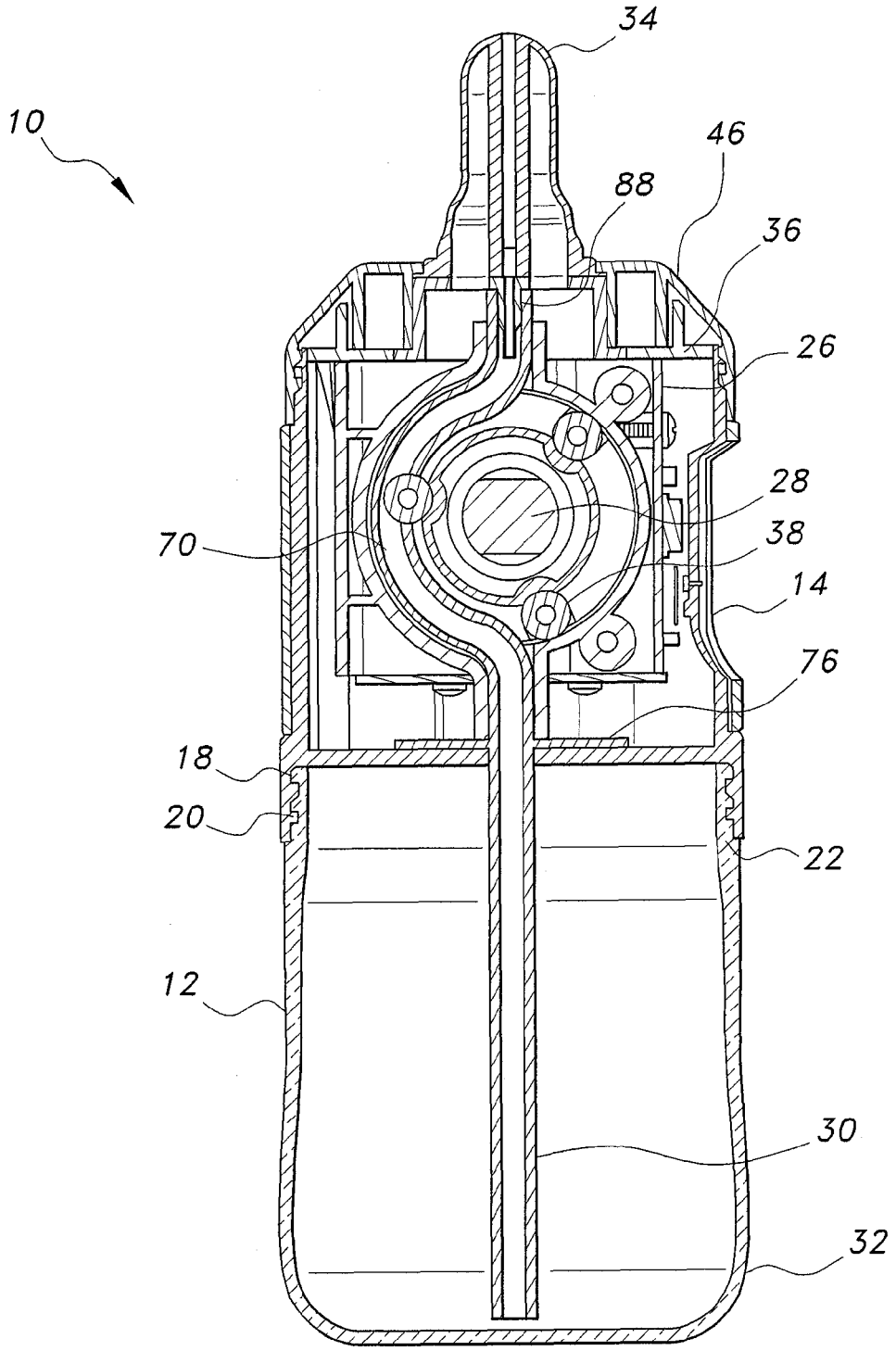
FIG. 4 is a section view along lines 4-4 of FIG. 1A.

Similar to conventional baby bottles, the lower housing member 12 can be configured for holding a volume of liquid therein. It is contemplated that the lower housing member 12 may be constructed of glass or a suitable plastic material, which may be clear or translucent. The clear or translucent construction permits the caregiver to visually monitor the amount of nutrient or liquid that is being dispensed from the nursing bottle 10 during operation. As illustrated in FIG. 1B, the lower housing member 12 includes an opening 16 at an upper portion 22 thereof. The lower housing member 12 can be configured to removably attach to the upper housing member in any suitable manner. For example, the upper portion 22 of the lower housing member 12 may include a first threaded portion 18 and the upper housing member 14 can include a second threaded portion 20 (as seen in FIG. 4) to cooperatively engage the first threaded portion 18 of the lower housing member 12. As such, the threaded portions 18, 20 provide a sealed connection between the respective housing members 12, 14, which together form the container of the nursing bottle 10.

As illustrated in FIG. 4, the programmable control assembly 24 and pump assembly 26 are generally disposed in the upper housing member 14. However, it is contemplated that the control assembly 24 and pump assembly 26 may be provided in the lower housing member 12, if desired. The pump assembly 26 includes a motor 28, configured for transferring power from a power supply 40 to the pump assembly 26. As described in detail below, the control assembly 24 regulates the power from the power supply 40 to the operatively connected pump assembly 26 and motor 28, and thereby controls fluid flow to a user.

Figure 3:
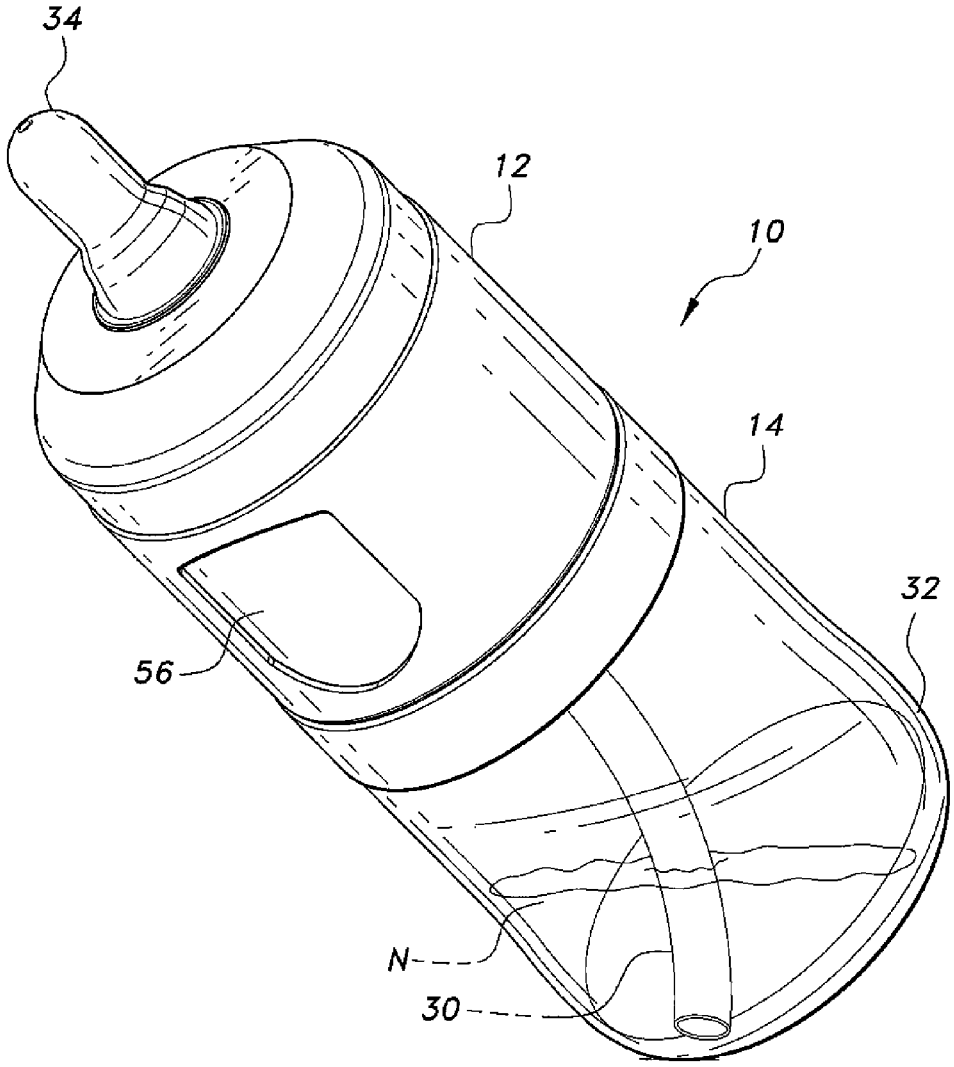
FIG. 3 is an environmental view of the programmable nursing bottle of FIG. 1A, illustrating the nursing bottle in a generally upright angled position and a tube member immersed in the bottle contents to facilitate feeding.

The tube member 30 extends generally from a lower portion 32 of the lower housing member 12, through the pump assembly 26, and to the nipple 34 for delivering nutrients such as liquid, milk or water to a user. The tube member 30 extends through an upper portion 36 of the upper housing member 14 and connects to an internal inlet 88 (as seen in FIGS. 4 and 6B) of the nipple 34. The tube member 30 may be flexible, semi-flexible or relatively rigid and of a suitable plastic material. The nipple 34 is secured to the upper housing member 14 by a cap member 46 which has an opening 58. As illustrated in FIG. 3, in order for fluid to flow from the nursing bottle 10 through the tube member 30, the nursing bottle 10 needs to be positioned in a generally upright or angular position such that a lower portion of the tube member 30 contacts the nutrients N located at the lower portion 32 of the lower housing member 12.

Figure 5:
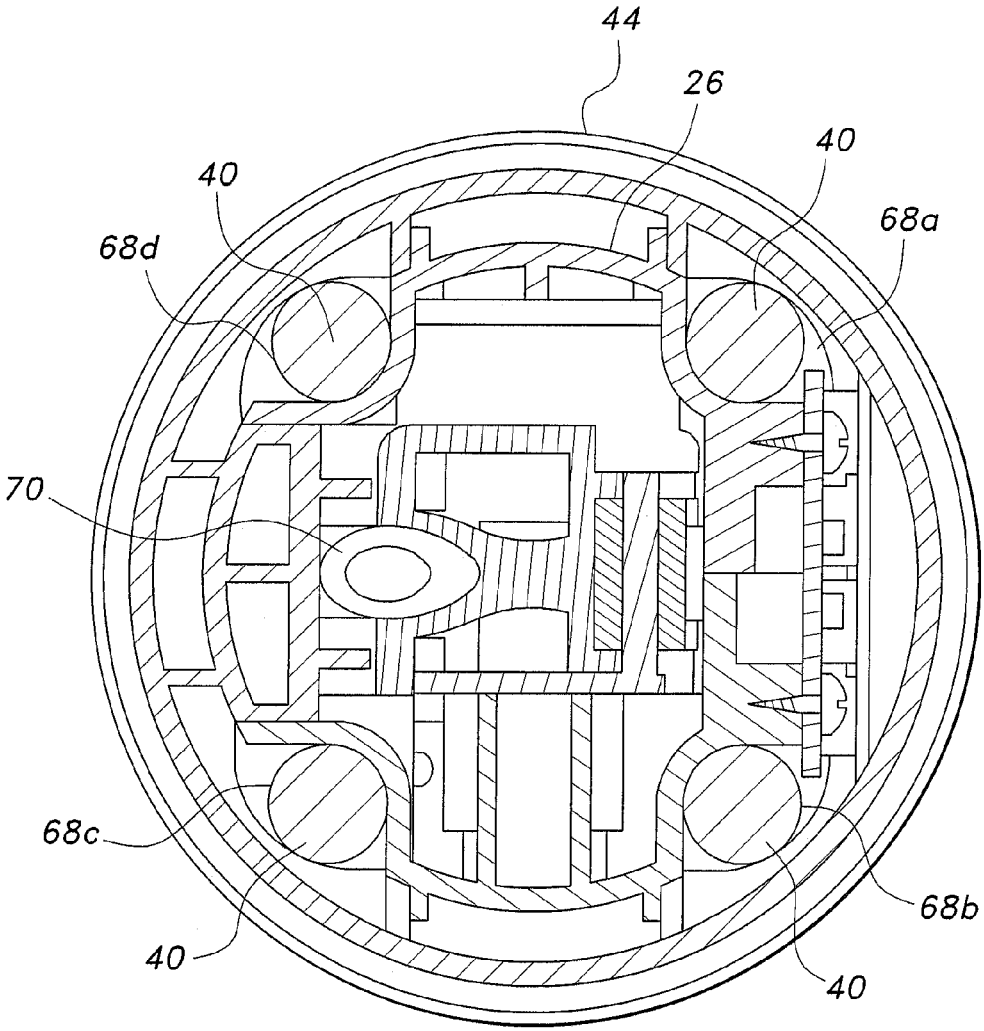
FIG. 5 is a section view along lines 5-5 of FIG. 1A.

The pump assembly 26 can include a conventional peristaltic pump, for providing continuous liquid to the delivery line or tube member 30. As further illustrated in FIG. 4, the pump assembly 26 can include one or more rollers 38 that operatively engage a portion of the tube member 30 disposed within the pump assembly 26. The rollers 38 may be configured to progressively compress the wall of the tube member 30, thereby forcing or conveying liquid therethrough. Notably, other types of pumps may be used in pump assembly 26, if desired. The pump assembly 26 is selectively driven by the motor 28, which as previously stated, receives power from a power supply 40. As illustrated in FIG. 5, the power supply 40 may include one or more batteries 40, or a rechargeable electrical storage cell or battery pack disposed within the housing member 14. For example the power supply 40 can include four batteries, each disposed separately in individual compartments. The battery compartments can be equally spaced from each other.

The pump assembly 24 may be connected to the motor 28 through a magnetic coupling or a direct connection (not shown). As such, a magnetic drive can be provided between the motor 28 and the pump 26. The drive may utilize a magnet (not shown) with a rotating polarity driven by the motor 28. A corresponding magnet or ferromagnetic component at the pump assembly 26 may be driven by the rotation of the drive magnet. Such magnetic drives are well known in the field of small motor drive systems.

The control assembly 24 is in electrical communication with the motor 28 and/or power supply or batteries 40. The control assembly 24 controls the power delivered to the motor 28 by the power supply 40, thereby controlling the speed, operating time, pause time, and/or other factors relating to the operation of the pump assembly 26 and its delivery of liquid from the nursing bottle 10. The control assembly 24 may include an input interface such as programmable keypad 42, which as shown in FIG. 1A, may be disposed in the upper housing member 14. It is contemplated that the input interface may also be remotely connected to the control assembly 24 using Bluetooth or other forms of signal transmission. Using the keypad 42, the control assembly 24 may be programmed to provide a variety of flow rates. For example, the control assembly 24 can include a programmable timer which may be programmed to allow small amounts of liquid to be dispensed, with intermittent pauses, to provide a more natural feeding.

Figure 2A:
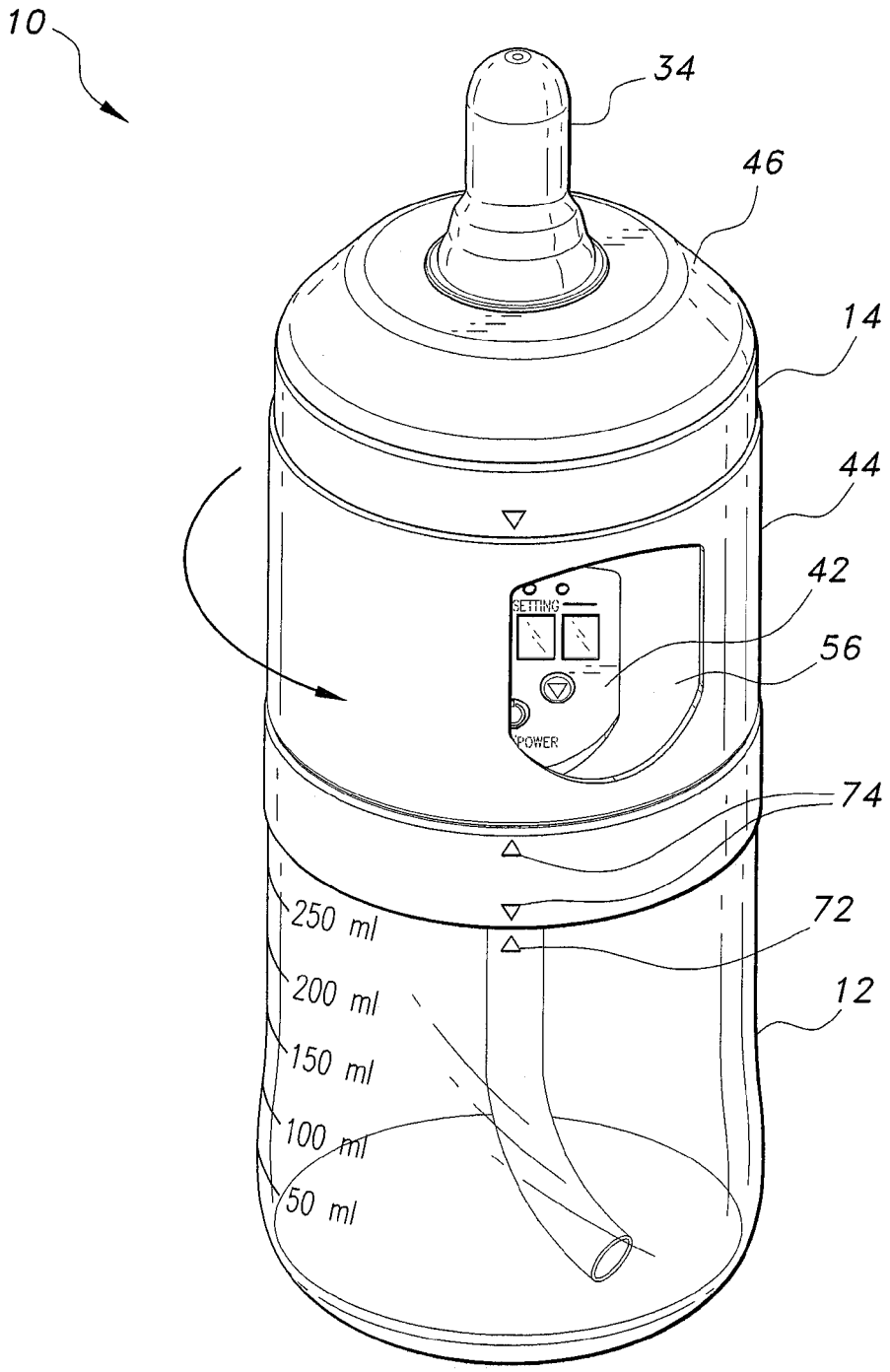
FIG. 2A is a perspective view of the programmable nursing bottle of FIG. 1A, illustrating a sliding door member rotating from an open position to a closed position to permit fluid flow.
Figure 2B:
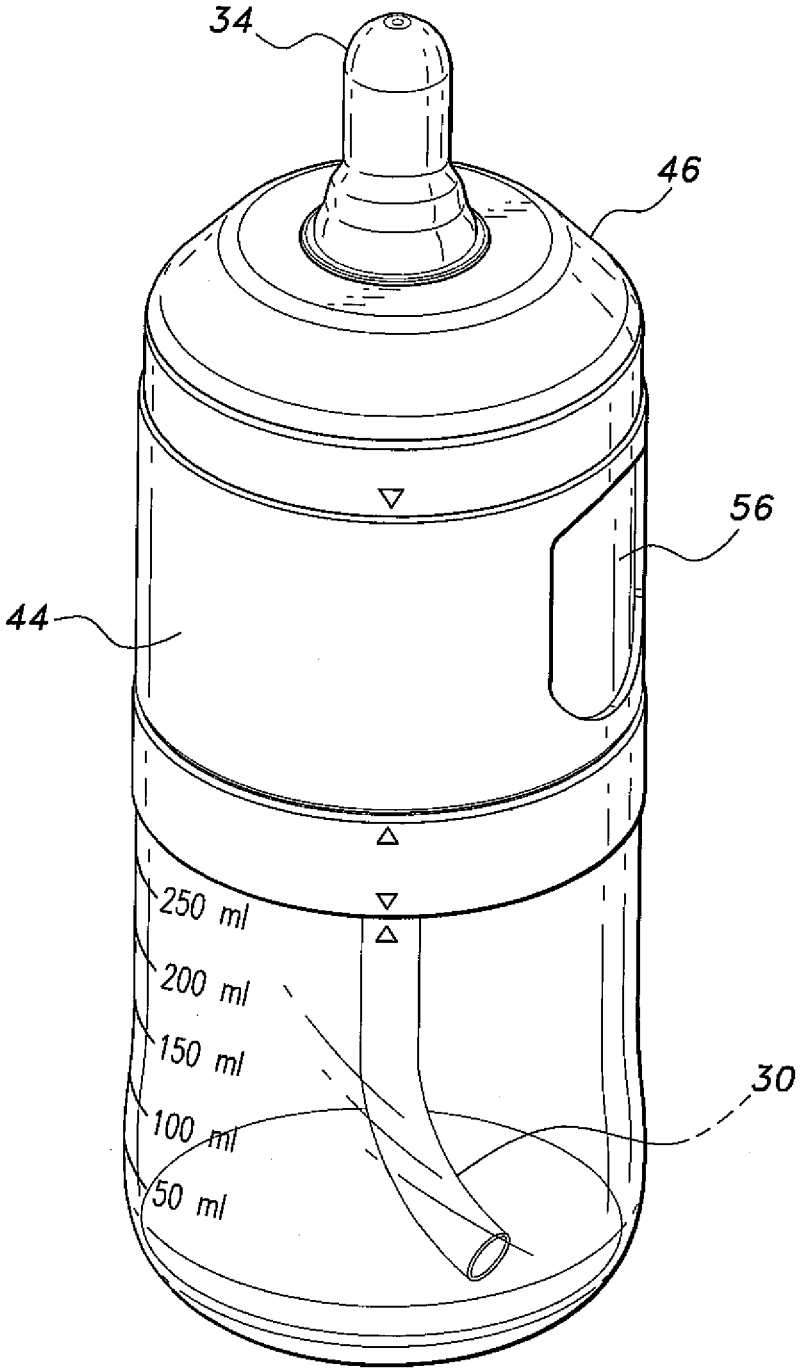
FIG. 2B is a perspective view of the programmable nursing bottle of FIG. 1A, illustrating the sliding door member covering the control panel in a generally closed position thereby permitting bottle operation.

The sliding door member 44 actuates operation of the nursing bottle 10 between an on and off position and protects a user interface. The sliding door member 44 may have a generally cylindrical configuration, and cooperatively engages at least a portion of the circumference of the upper housing portion 12. As illustrated in FIG. 1A the door member 44 is slidably rotatable from an open position to a closed position. In an open position, the keypad 42 of the control system 24 is exposed to the user through an aperture or window 56 formed in the sidewall of the slidable door member 44. The user slidably rotates the door member 44 about the outer circumference such that the keypad 42 is exposed, as seen in FIG. 2A in order to enter operating mode or instructions on the key pad 42. After the instructions are provided, the nursing bottle 10 is only activated once the slidable door member 44 is rotated to a closed position, as illustrated in FIG. 2B, and the keypad 42 is covered by the door member 44. Once the slidable door member 44 is positioned in a closed position, a signal is sent to the control assembly 24, activating a start switch 60 (as seen in FIG. 9) signaling the pump assembly 26 to commence fluid flow.

The position of the various components are interchangeable with one another, e.g., the programmable keypad 42, and/or pump assembly 26 may be installed in the lower housing member 12 or in other suitable bottle configuration as desired.

Figure 9:
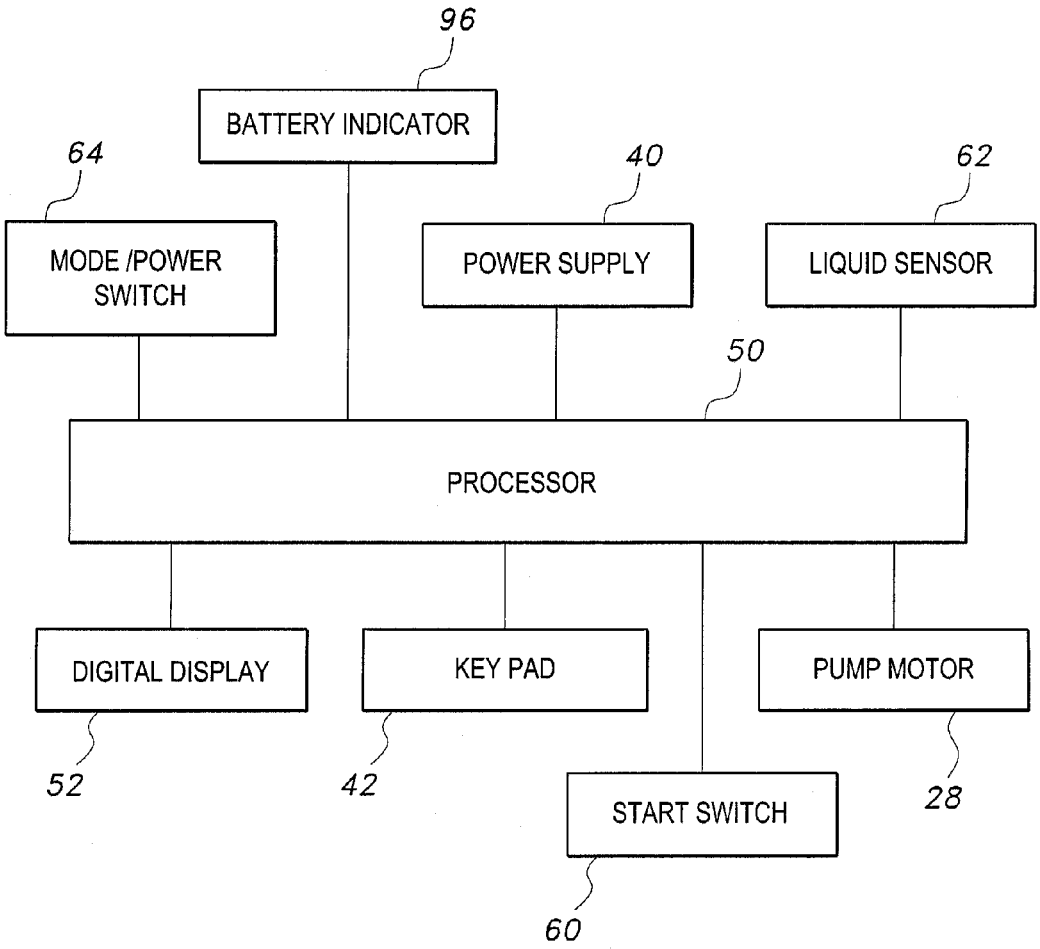
FIG. 9 is a schematic diagram of the control assembly for controlling the programmable nursing bottle.

FIG. 9, illustrates an exemplary configuration of the external controls and display of the programmable nursing bottle. The programmable control assembly 24 is shown schematically in FIG. 9. The programmable control assembly 24 typically includes a microprocessor controller 50, the programming of which is well within the ability of a person of ordinary skill in the art. The programmable controller 50 can regulate the volume of liquid pumped and the length of pauses between pumping for each feeding cycle. The volume of liquid may be adjusted by selecting the speed using a remote interface or the programmable keypad 42. An LED digital display 52 may also be provided to indicate volume of liquid, as for example, the height or amplitude shown on the display or the pause indicated by one-half wavelength. It is further contemplated that the programmable nursing bottle may include a liquid sensor 62 that detects the level of the nutrient in the lower housing member 12

The control assembly 24 may also include a volume control feature that allows the caregiver to adjust the rate of flow or volume of each pulse of liquid delivered, and a pause timer control to adjust the time between each pulse of liquid. A display 52 is provided to enable the caregiver to visually determine the magnitude of each pulse of liquid, the duration of the pulses, and the time interval between pulses. The control assembly 24 and the display 52 are conventional, such controls and display 52 being well known in the art of microcomputerized pump controls. The nursing device 10 is programmable to deliver positive liquid flow from the nipple 34 of the nursing bottle 10 in a series of intermittent pulses simulating the natural sucking reflex of an infant and giving the infant time to swallow after each pulse.

Figure 6A:
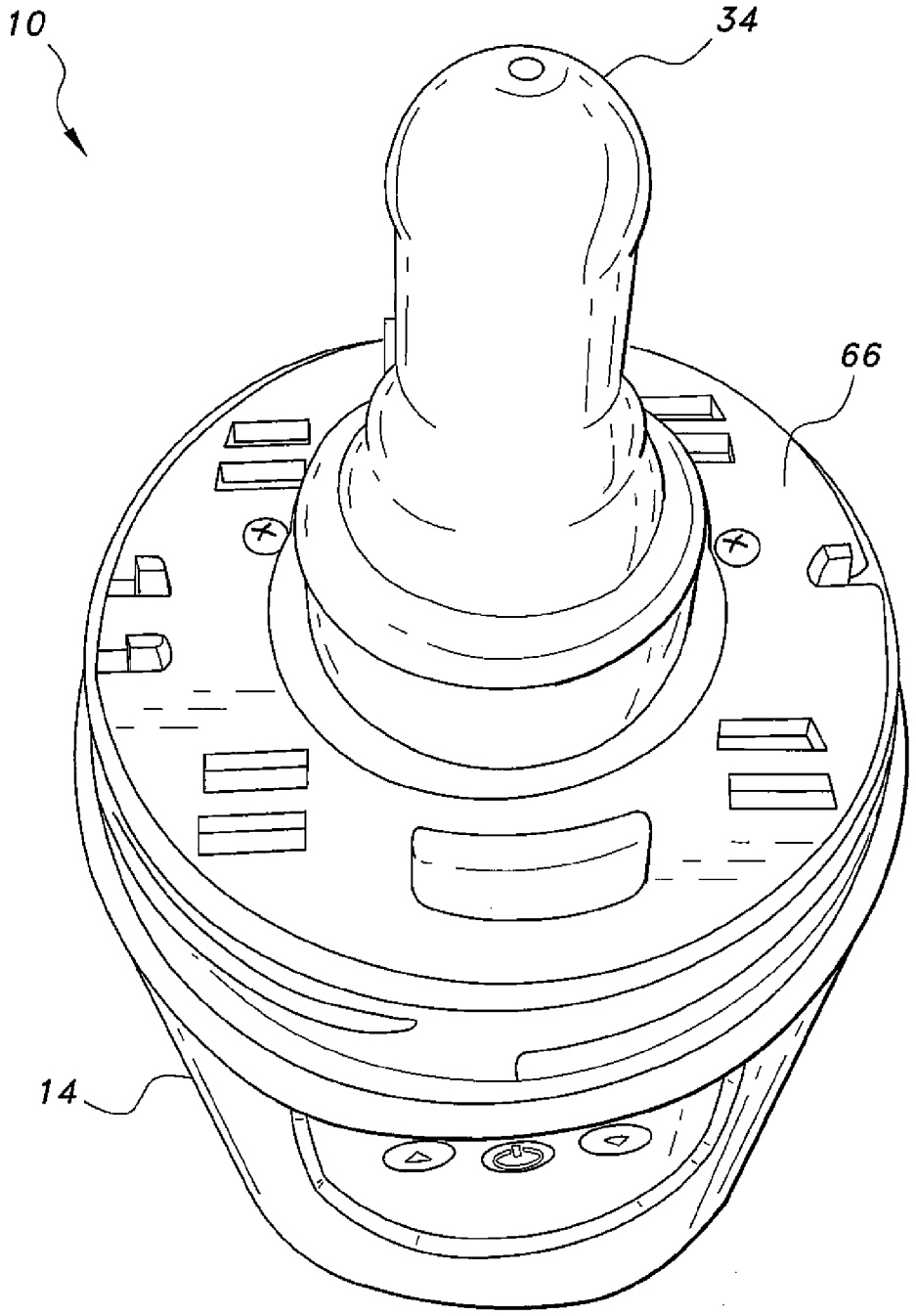
FIG. 6A is an environmental top perspective view of the programmable nursing bottle of FIG. 1A, with a cap member removed therefrom for permitting nipple replacement.
Figure 6B:
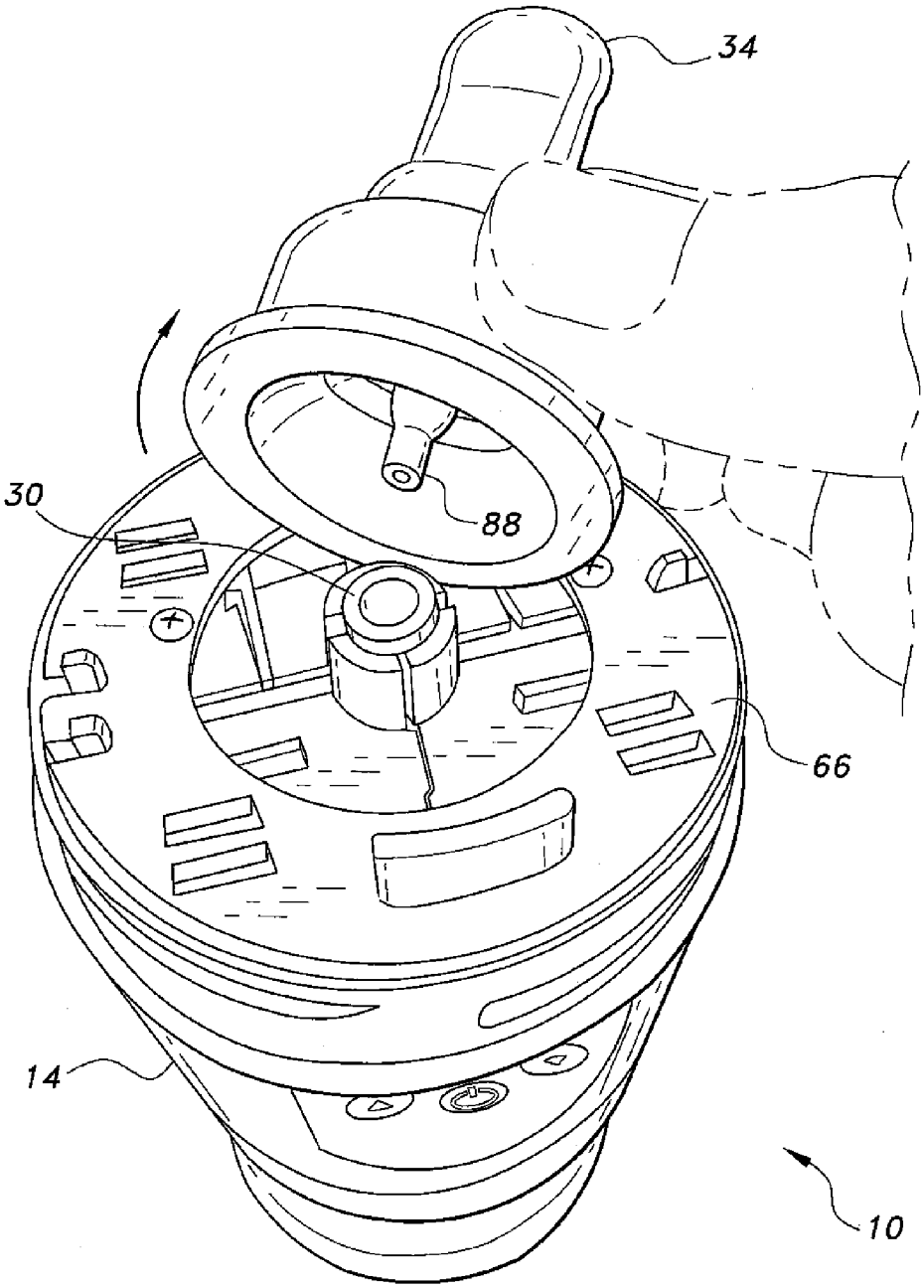
FIG. 6B is an environmental top perspective view of the programmable nursing bottle of FIG. 1A, illustrating removal of the nipple from a top portion of the housing.
Figure 7A:
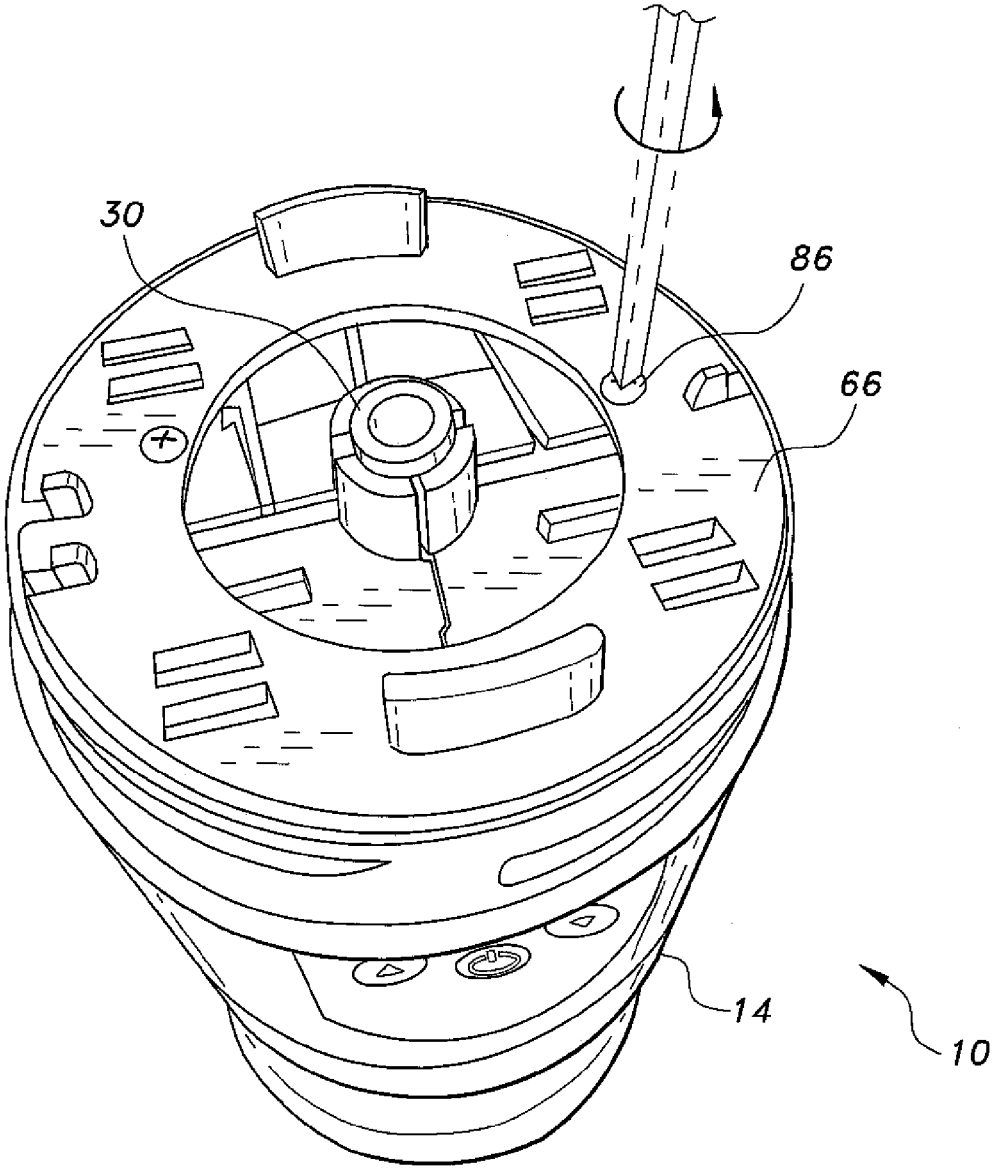
FIG. 7A is top view of the programmable nursing bottle of FIG. 1A, depicting removal of a battery compartment cover from the top portion of the upper housing member to facilitate battery replacement.
Figure 7B:
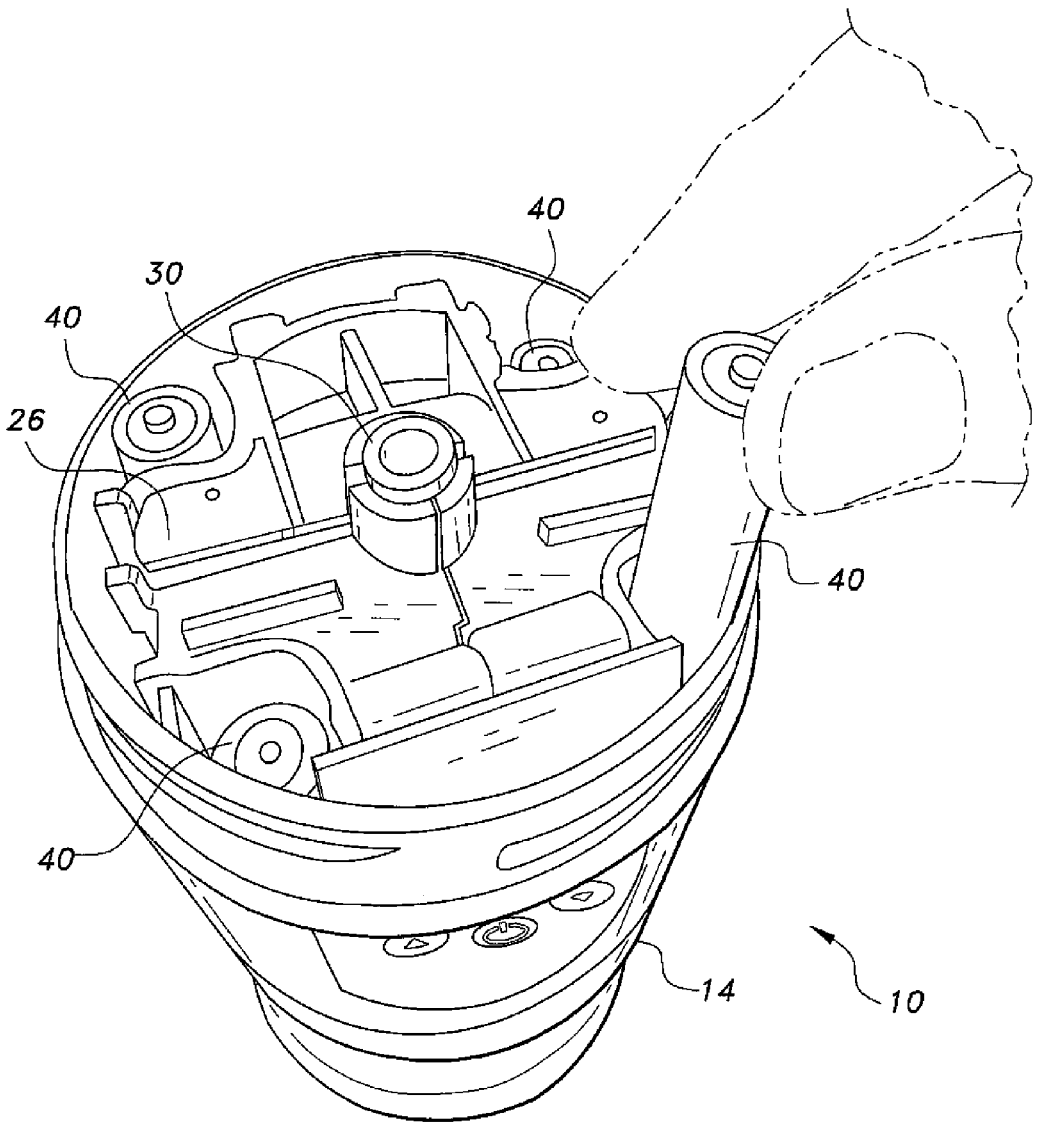
FIG. 7B is a top view of the programmable nursing bottle of FIG. 1A with the battery cover removed from the upper housing member, illustrating battery removal therefrom.
Figure 8A:
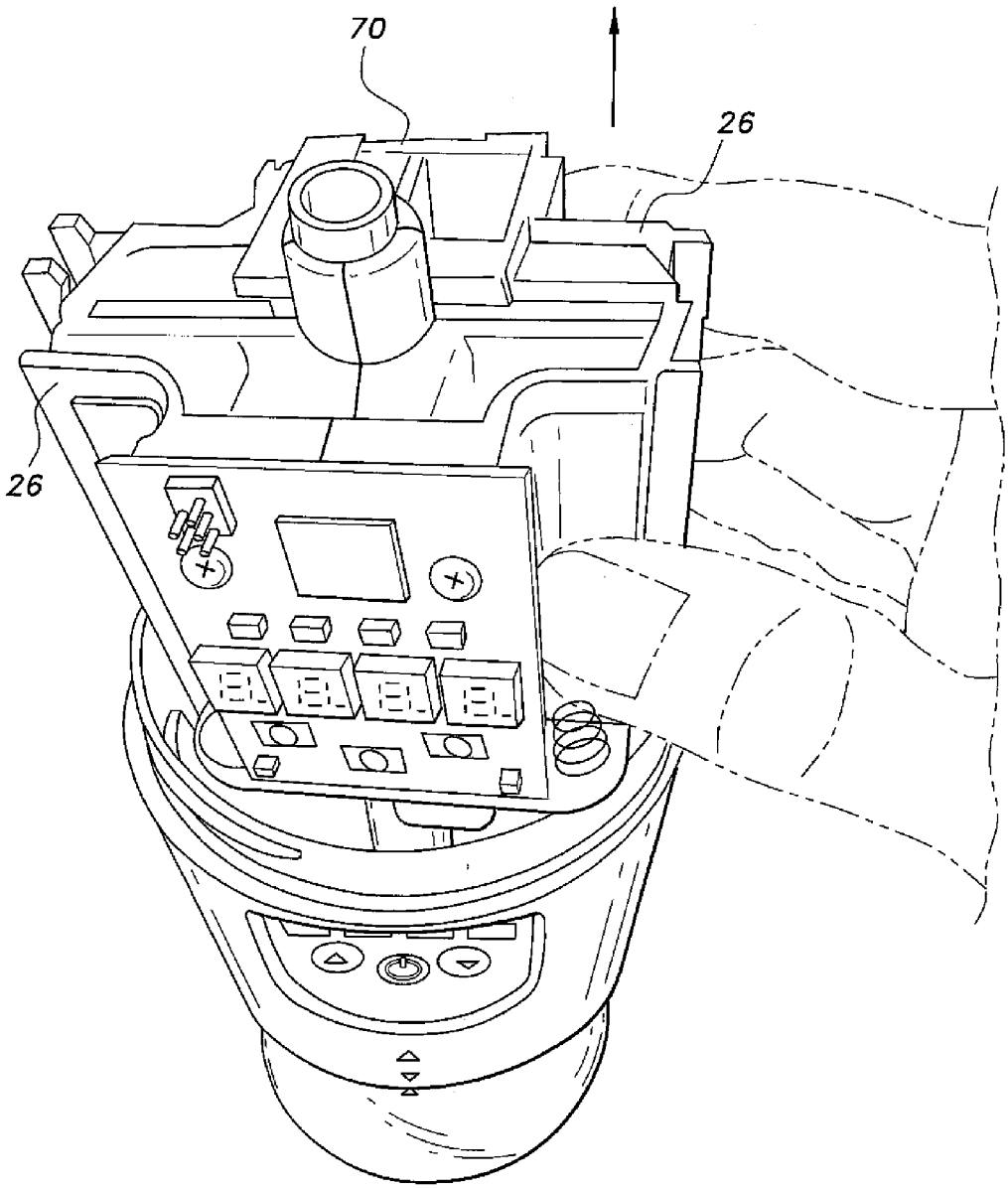
FIG. 8A is a perspective view of the programmable nursing bottle of FIG. 1A, illustrating removal of the pump assembly from the upper housing member in order to permit tube member replacement.
Figure 8B:
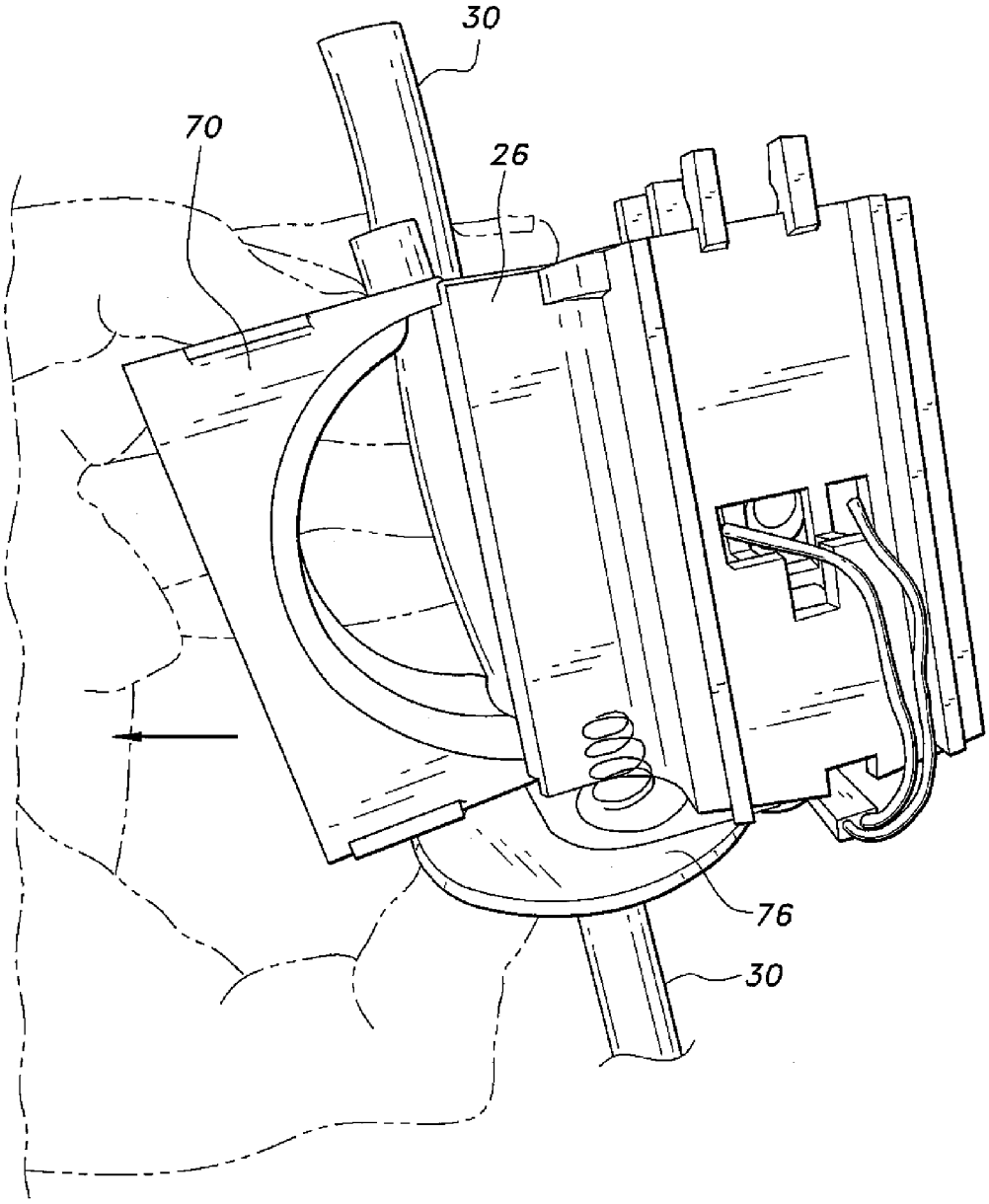
FIG. 8B is a side view of the pump assembly, illustrating removal of a side door member of the pump assembly to facilitate tube member replacement.
Figure 8C:
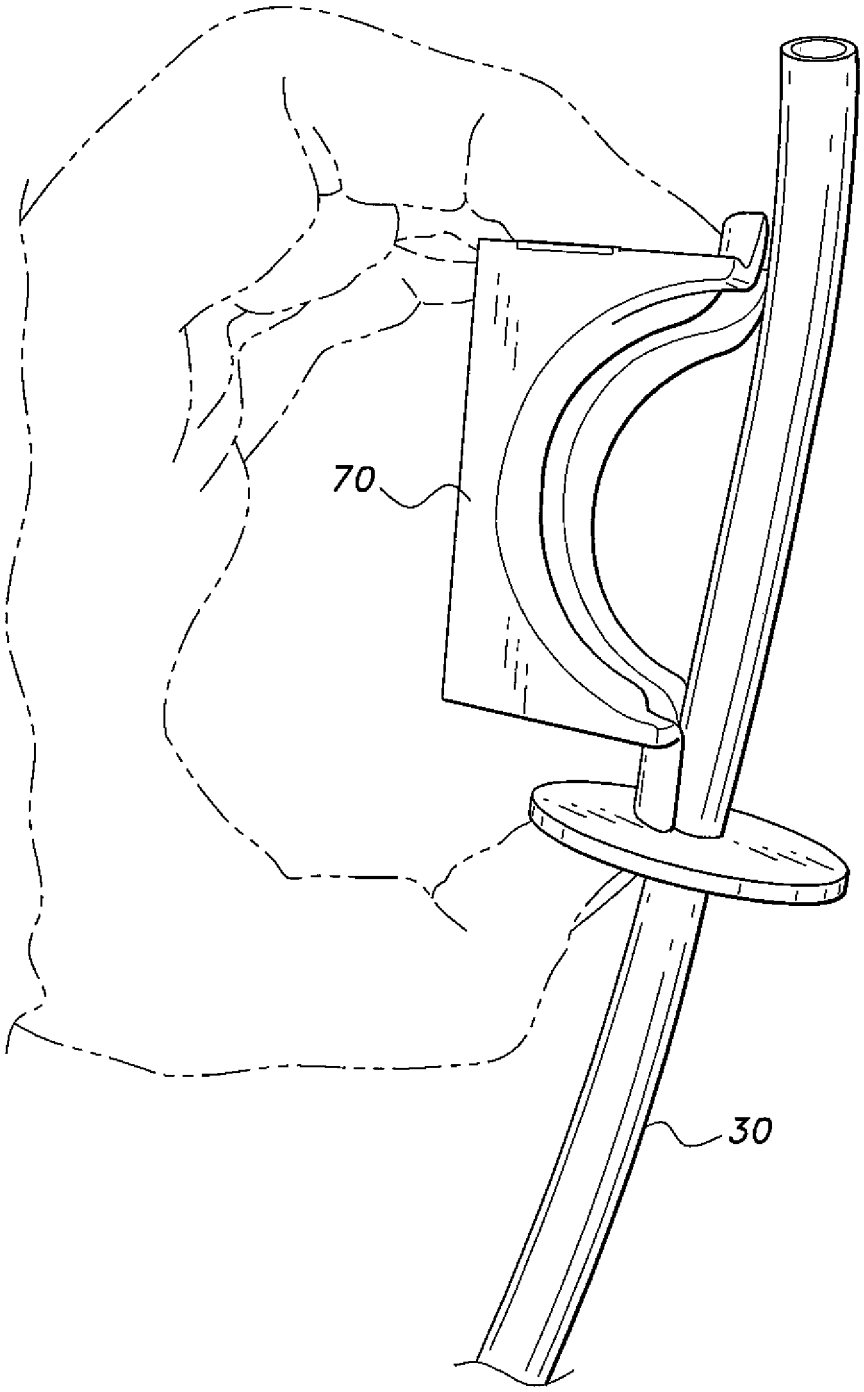
FIG. 8C is a perspective view illustrating insertion of a replacement tube member into the side door member of the pump assembly.
Figure 8D:
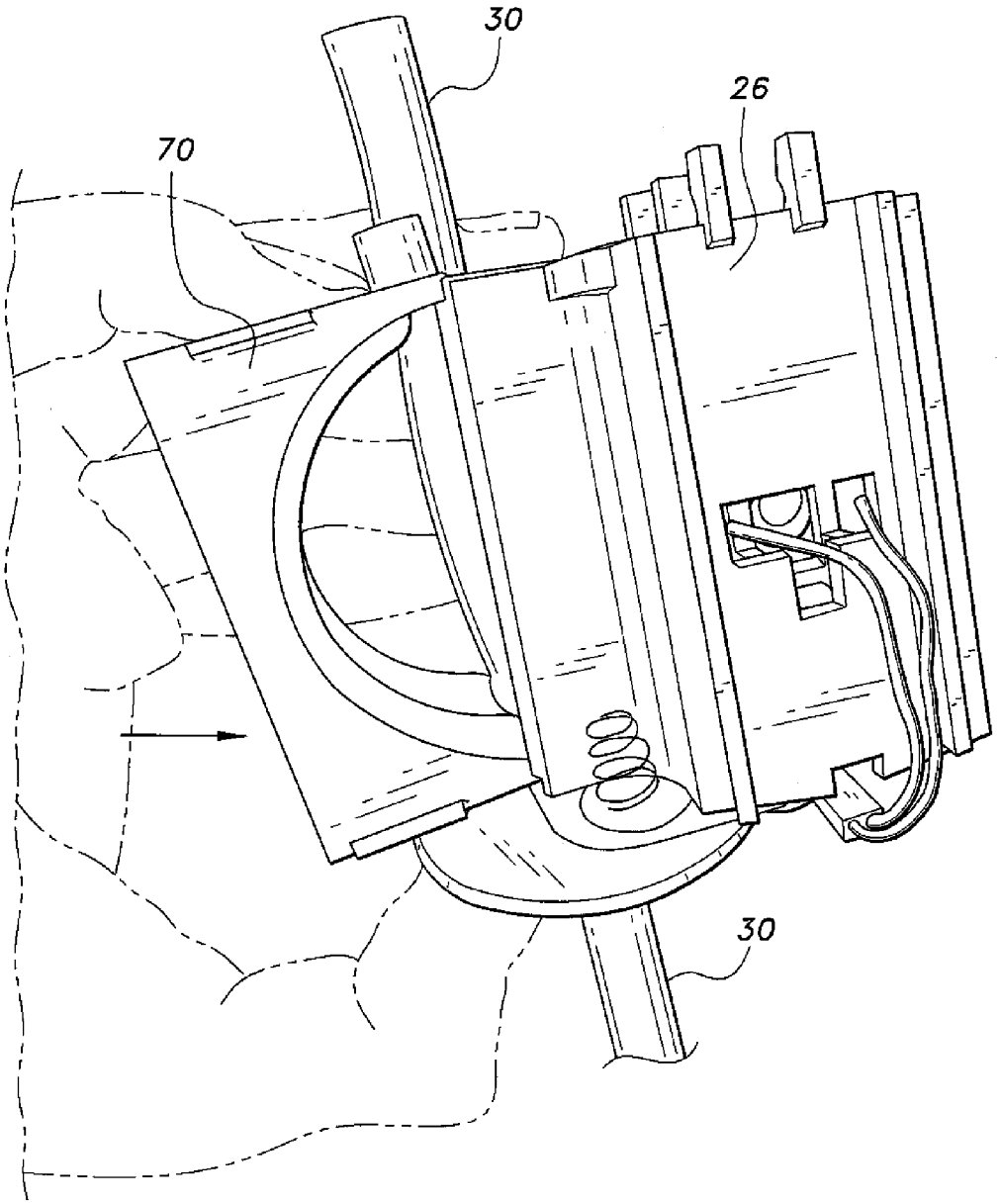
FIG. 8D is side view illustrating insertion of a replacement tube member into the pump assembly.
Figure 8E:
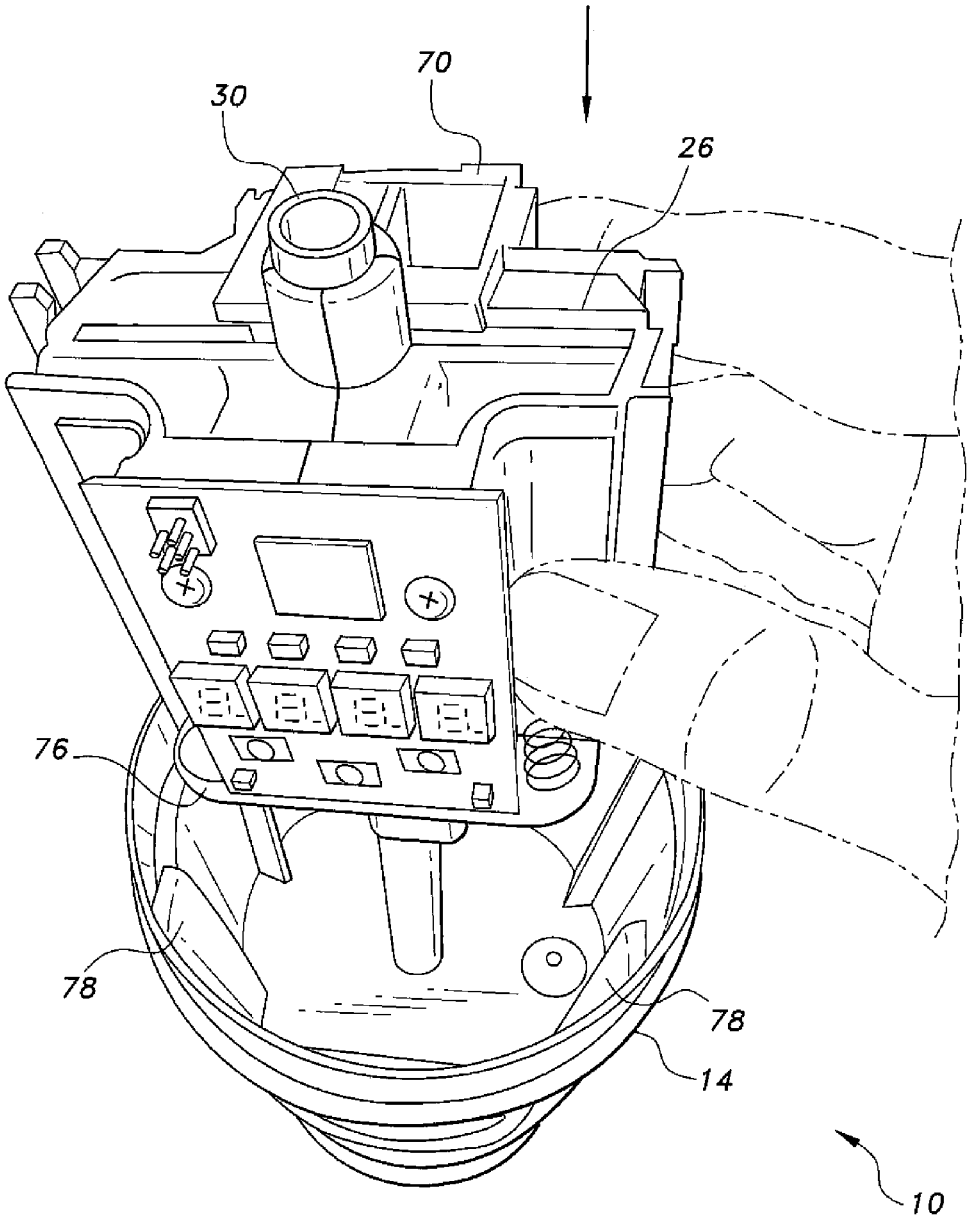
FIG. 8E is a top perspective view of the programmable nursing bottle, illustrating insertion of the pump assembly into the upper housing member.

In an embodiment illustrated in FIGS. 5 and 6A, 6B, the upper housing member 14 provides one or more compartments adapted for receiving one or more batteries 40 to power the motor 28. As illustrated, the upper housing member 14 may provide four battery compartments 68*a-d* disposed in equidistance from a central axis C of the upper housing member 14 so as to provide an equal weight distribution to the nursing bottle 14 when batteries 40 are inserted therein.

The programmable nursing bottle 10 is configured to permit the user to remove and or replace the batteries 40. As illustrated, in FIGS. 7A-7B, the batteries 40 may be removed by first removing the top cap member 46, fasteners 86, and then removing a battery cover 66. Removal of the cap member 46 and battery cover 66 permits the user to access the batteries compartments 48*a-d*, and thus selectively remove or replace the batteries 40, as needed.

The nursing bottle 10 provides a simple configuration which permits the user to replace the tube member 30. As illustrated in FIGS. 4 and 8A-8E, the pump assembly 24 includes a tube holder 70 which retains the tube 30 while the rollers 38 progressively compress the wall of the tube member 30 to force liquid therethrough. The tube holder 70 permits the user to access the tube member 30 therein for removal or replacement. Similar to the battery removal process, after removal of the top cap member 46, the pump assembly 26 is removable from the upper housing member 14. The tube holder 70 may be pulled out of the upper housing member 14 of the nursing bottle 10 by the user, thus allowing the user to remove and replace the tube member 30. A replacement tube member 30 may then be inserted in the tube holder 70 and the tube holder 70 may be repositioned between aligning support grooves 78 on a pump housing base 76.

To operate the nursing bottle 10 the user accesses the interface 42 and programs the control assembly and connected controller. The door member 44 is then moved into a closed position, as shown in FIG. 2B. It is contemplated that the controller 50 may be programmed to activate operation of the motor within approximately 5 seconds. However, this time frame may be adjusted according to user preference. To stop operation, the door member 44 is slid into an open position. The user then may depress and hold a Mode/Power button 64, which then deactivates the motor 28 and the display 52 and battery indicator lights 96 go off.

The programmable nursing bottle permits a user to selectively control the flow of nutrients from the nursing bottle to the user via the control assembly which is operatively connected to the pump assembly. The programmable controller permits the user to preselect the flow rate and/or volume flow of nutrients to be delivered. The programmable nursing bottle is particularly useful for individuals, e.g., infants, elderly individuals, who have little or no ability to suck nutrient from an ordinary feeding bottle.

It is to be understood that the present invention is not limited to the embodiments described above, but encompasses any and all embodiments within the scope of the following claims.

I claim:

1. A programmable nursing bottle, comprising:

a first housing member configured to hold a liquid therein;

a second housing member removably attached to the first housing member;

a tube member extending from the first housing member to the second housing member;

a pump assembly and a motor disposed in the second housing member and configured to pump fluid from the first housing member through the tube member;

a programmable control assembly including an interface and a controller operatively connected to the pump assembly; and a sliding door member provided about the second housing member configured to slide between an open position and a closed position, wherein in an open position the user is able to access the user interface to control the controller and in a closed position the sliding door member activates the controller and a connected motor to initiate fluid flow.

2. The programmable nursing bottle of claim 1, wherein the first housing member is a lower housing member and the second housing member is an upper housing member above the lower housing member.

3. The programmable nursing bottle of claim 1, wherein the sliding door member has a cylindrical configuration.

4. The programmable nursing bottle of claim 1, wherein the sliding door member is operatively connected to the pump assembly.

5. The programmable nursing bottle of claim 1, wherein the sliding door member includes an aperture formed therethrough permitting access to the user interface in an open position.

6. The programmable nursing bottle of claim 1, wherein the pump assembly is centrally disposed within the second housing member.

7. The programmable nursing bottle of claim 1, wherein the pump assembly includes a removable tube holder, the tube member being retained within the tube holder.

8. The programmable nursing bottle of claim 7, wherein at least a portion of the tube member in the tube holder is in contact with one or more rollers of the pump assembly.

9. The programmable nursing bottle of claim 1, further including at least one battery compartment provided in the second housing member.

10. The programmable nursing bottle of claim 9, wherein the at least one battery compartment includes four battery compartments positioned equidistant from a center axis of the second housing member, each compartment including one battery therein.

11. The programmable nursing bottle of claim 1, wherein the battery compartment includes a battery compartment door at an upper portion of the second housing member.

12. The programmable nursing bottle of claim 1, wherein the second housing member and first housing member include mating threaded portions.

13. A programmable nursing bottle, comprising:

a first housing member configured to hold a liquid therein;

a second housing member removably attached to the first housing member;

a tube member extending from the first housing portion to the second housing portion;

a pump assembly in the second housing member, the pump assembly including a peristaltic pump and a motor, the pump assembly being configured to pump fluid from the first housing member through the tube member;

a programmable control assembly including an interface and a controller operatively connected to the pump assembly; and a power supply provided in the second housing member, the power supply being in communication with the control assembly;

wherein the power supply is removable from the upper housing member.

14. The programmable nursing bottle of claim 13, further including a sliding door member provided about the second housing member, the sliding door member being movable to expose the user interface in a first position and cover the user interface in a second position.

15. The programmable nursing bottle of claim 13, wherein the sliding door member is operatively connected to the control assembly such that movement of the sliding door member from a first position to a second position activates the control assembly to activate the pump assembly.

* * * * *